United States Patent [19]

Montgomery

[11] Patent Number: 4,535,392

[45] Date of Patent: Aug. 13, 1985

[54] PERSONAL ALERT SIGNAL

[76] Inventor: William J. I. Montgomery, 9250 Pinetree Rd., Sidney, B.C., Canada, V8L 3W2

[21] Appl. No.: 576,160

[22] Filed: Feb. 2, 1984

[51] Int. Cl.[3] ..... F21L 7/00

[52] U.S. Cl. ..... 362/186; 362/86; 362/103; 362/183; 362/190; 362/191; 362/196; 362/205; 362/253; 362/295; 362/7; 362/800; 200/60

[58] Field of Search ..... 362/7, 86, 183, 186, 362/196, 205, 253, 295, 800, 103, 190, 191

[56] References Cited

U.S. PATENT DOCUMENTS

| | | | |
|---|---|---|---|
| 3,766,538 | 10/1973 | Dealy | 340/729 |
| 4,069,404 | 1/1978 | Minoprio | 362/200 X |
| 4,204,272 | 5/1980 | Kim | 362/200 |
| 4,228,484 | 10/1980 | Johnstone | 362/800 X |
| 4,283,169 | 8/1981 | Tuomala | 362/11 X |
| 4,283,756 | 8/1981 | Beamon | 362/252 X |
| 4,298,917 | 11/1981 | Ware | 362/800 X |
| 4,314,317 | 2/1982 | Robson | 362/189 |
| 4,345,305 | 8/1982 | Kolm | 362/186 |
| 4,375,634 | 3/1983 | Lewis | 362/246 X |
| 4,423,473 | 12/1983 | Kirkley | 362/200 X |
| 4,451,871 | 5/1984 | Kirkley et al. | 362/200 X |

FOREIGN PATENT DOCUMENTS

| | | | |
|---|---|---|---|
| 1071292 | 2/1980 | Canada | 315/1 |
| 1138394 | 12/1982 | Canada | 240/41 |

*Primary Examiner*—Stephen J. Lechert, Jr.
*Attorney, Agent, or Firm*—Hayes Davis & Soloway

[57] ABSTRACT

The specification describes a safety flasher for use by pedestrians, bicyclists and the like for producing a flashing signal, the flasher comprising a casing, a battery in the casing, a lamp secured to and extending exteriorly from the casing and circuit means in the casing connecting the battery and lamp for selectively actuating the lamp, the circuit means including acceleration responsive switch means for causing the lamp to flash ON and OFF.

11 Claims, 7 Drawing Figures

PERSONAL ALERT SIGNAL

BACKGROUND OF THE INVENTION

Safety flashers are well known effective warning devices which are used in conditions of reduced visibility and/or at night and have been employed in association with aircraft, emergency vehicles, on construction barricades and the like. Hazard lights, now adopted as standard equipment on wheeled conveyances for use when the conveyance is stalled or parked, demonstrate the advantage of coloured flashing lights used to alert traffic of potential obstructions.

The beneficial features of safety flashers and hazard lights have not been adopted in a classification of lights which may be referred to as consumer or personal portable lights and which are generally known as flashlights. The reasons are not clear. It is possible that the cost of commercial safety flashers and hazard lights is prohibitive to the general consumer. Perhaps, the availability of flashlights may have pre-empted the use of safety flashers by individual consumers. In any case, it is believed that a flashing light is preferred to a non-flashing light for pedestrian or bicyclist use because flashing lights are generally regarded as alerting or cautioning signals to which people respond rapidly. For similar reasons, it is preferred to use coloured lights as opposed to white lights.

As is well known, domestic flashlights are not normally used in a flashing mode to provide a flashing signal; rather, they are normally used in a continuous mode to selectively illuminate a particular area. Additionally, domestic or conventional flashlights normally utilize white light reflected through a clear lens. Thus, domestic flashlights do not provide the advantages of safety flashers and hazard lights.

Domestic flashlights may provide a flashing light by means of a momentary switch and some are known to provide a bi-metallic lamp and coloured lens in a secondary circuit. The latter has not been generally accepted in either method and this may be a result of the ineffective, inconvenient and somewhat unreliable nature of the first feature or the weight and expense of the battery necessary to power the bi-metallic lamp with its associated delayed response in the circuit. A further disadvantage of conventional flashlights is that they tend to be viewed from one direction only, that is, from a head on direction.

SUMMARY OF THE INVENTION

The primary object of the present invention is to provide a safety flasher for use by general consumers in conditions of reduced visibility, such as night time use, and which are highly visible and relatively inexpensive.

The present invention provides a safety flasher generally comprised of a light weight casing which is comfortably held in one hand of a person. The casing is formed with a lens which protrudes from one end and which houses a lamp connected to an electrical circuit, including a battery, housed within the casing. The electrical circuit includes an acceleration responsive switch which causes the lamp to flash at a predetermined position of the casing with respect to the vertical (or horizontal). The term acceleration is intended to include acceleration caused by gravity.

The advantages of a safety flasher of this type are believed to be apparent. The flasher can be carried in the hand of the user, clipped to a shirt sleeve or pant leg and the oscillatory motion associated with walking, running or riding a bicycle causes the acceleration responsive switch to open and close in response thereto and the lamp to flash ON and OFF. The frequency at which the lamp flashes ON and OFF will be an indication of induced movement by the operator and/or of the speed of the pedestrian or bicyclist and this, therefore, will cause vehicular traffic to exercise corresponding caution.

BRIEF DESCRIPTION OF THE DRAWINGS

These and other features of the invention will become more apparent from the following description in which reference is made to the appended drawings, wherein.

DESCRIPTION OF A PREFERRED EMBODIMENT

Figure 1:
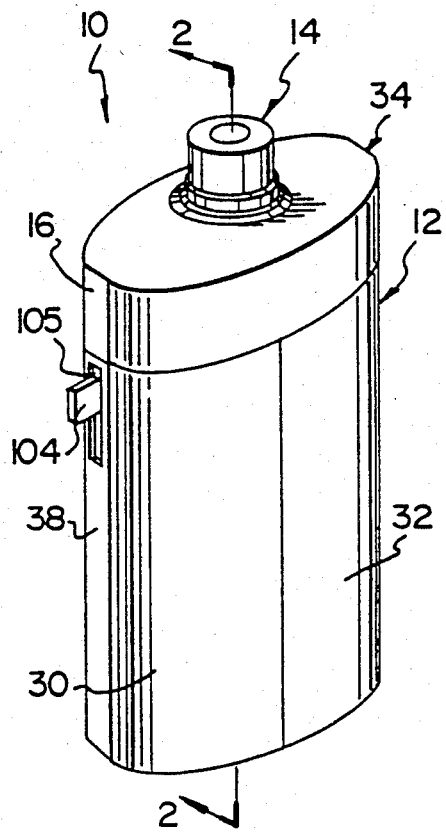
FIG. 1 is a perspective view of the safety alert device of the present invention.

The safety flasher device 10 of the present invention is generally comprised of a casing 12 having a lamp assembly 14 at one end 16 of the casing. A battery 18 is mounted in the casing and is connected to the lamp assembly by means of an electrical circuit generally designated by reference numeral 20. The electrical circuit includes a switching means 22 which is responsive to either gravity and/or acceleration of the casing for opening and closing the circuit and thereby causing the lamp to flash at a variable frequency under the control of the operator induced movement.

Thus, the device can be held in the hand of the user, attached to the user's shirt sleeve or pant leg or the sprocket of a bicycle in such a manner that the oscillatory motion associated with walking, running or riding a bicycle causes the lamp to flash ON and OFF.

Figure 2:
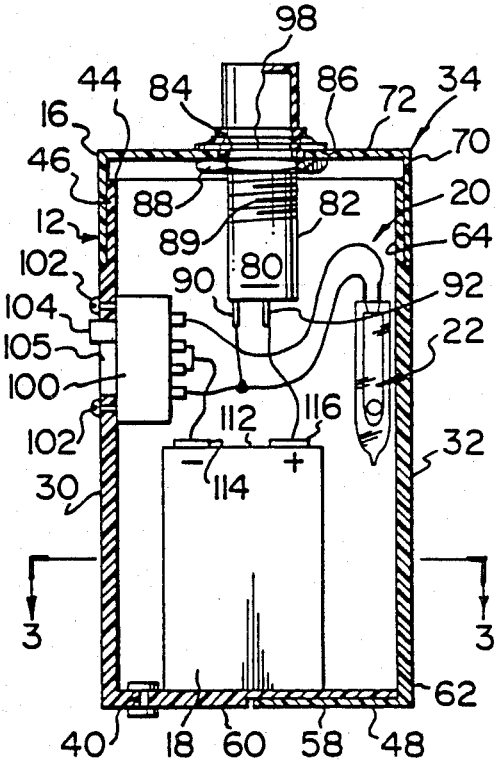
FIG. 2 is a longitudinal cross-sectional view of the device taken along line 2—2 of FIG. 1.
Figure 3:
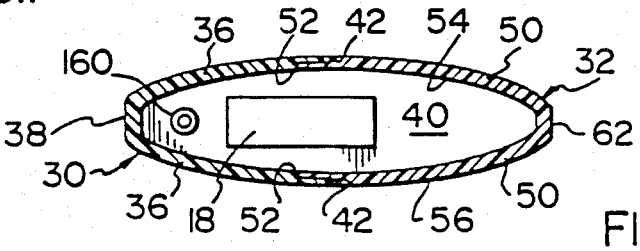
FIG. 3 is a transverse cross-sectional view of the device taken along line 3—3 of FIG. 2.

With reference to FIGS. 1–3 of the drawing, casing 12 is illustrated as being comprised of a pair of main body portions or halves 30 and 32 and a cap 34. Body 30 includes a pair of spaced convexly curved side walls 36,36 a longitudinal, planar end wall 38 and a bottom wall 40. Longitudinal edges 42 of side walls 36 are externally recessed to define portions of reduced thickness which are overlappingly and matingly received in body 32 while upper edge 44 thereof is similarly externally recessed to define a neck 46 of reduced thickness received in cap 34. Bottom wall 40 extends across the entire length and width of the casing and defines a support for the battery as shown. A recess 48 is formed on the underside of wall 40 as shown to receive the bottom wall of body 32 as explained below.

Body 32 is of similar construction except that its side walls 50,50 are internally recessed along longitudinal edges 52 to define portions of reduced thickness which receive edges 42 of body 30 and thereby define substantially flush internal and external surfaces 54 and 56.

Bottom wall 58 is formed to be received in recess 48 as shown to define a flush bottom surface 60 of the casing. As with body 30, body 32 is formed with a longitudinal, planar end wall 62 and a neck 64 of reduced thickness.

Cap 34 is formed with a side wall 70 having the same transverse cross section shape as bodies 30 and 32 when assembled and a planar generally top or end wall 72. As best shown in FIG. 2, the lower extremities of side wall 70 telescopingly receive necks 46 and 64 of portions 30 and 32 respectively so as to form a flush, substantially uninterrupted, casing external surface 56. If desired, body portions 30 and 32 and cap 34 may be permanently sealed together. Alternatively, they may be releasably attached together in any suitable fashion so as to enable replacement of any of the components described hereinbelow.

Lamp assembly 14 (FIGS. 2 and 4) is secured generally centrally in and to top wall 72 of cap 34. Assembly 14 includes a base 80 having a cylindrical portion 82 received through a circular aperture 84 formed in top wall 72 of cap 34. Base 80 includes a shoulder 86 which abuts the outer surface of wall 72 and a nut 88 which threadedly engages threaded upper end 89 of portion 82 and abuttingly engages the underside of wall 72 so as to thereby rigidly secure the base to the cap. The base further includes a pair of terminals 90 and 92 for communicating electrical current to a bayonet-type incandescent lamp 94 received in a socket 96 of base 80. Finally, a cylindrical coloured lens 98 is threadedly secured to threaded upper end portion of socket 96 of base 80 to permit replacement of lamp 94.

As previously mentioned, it is considered particularly advantageous that the lens of the device be viewable not only head on, but also from all sides in order to provide optimum visibility. The assembly as described above and illustrated in the drawings is believed to satisfy that objective. It will be understood that the lens may be made to assume any suitable size and shape consistent with this objective, including the transverse cross-sectional shape of the casing and that the end of the lens may be provided with a non-coloured or clear portion or aperture in order to provide a spotlight function.

A three position center "OFF" slide switch 100 is secured to the inside of the upper end of longitudinal end wall 38 of main body 30, as shown in FIG. 2, by means of screws 102, 102. Actuating member 104 of switch 100 extends outwardly of body 30 via aperture 105. Switch 100 further includes four terminals, two common terminals 106, a "flash" terminal 108 and a "continuous" terminal 110.

Battery 18 is supported by bottom wall 40 of body 30 with its upper end 112 in close proximity to the underside of switch 100 so as to prevent longitudinal movement of the battery within the casing. The battery is preferably of a 9-volt, rechargable, dry cell type having a negative terminal 114 and a positive termnal 116. Switch means 22 is secured to the inner upper end of the planar end wall of body 32 in an orientation described more fully hereinbelow.

As previously mentioned, switch 22 is of the type which is responsive to acceleration, the term "acceleration" being construed sufficiently broadly so as to include that produced by gravity, so that oscillatory movement associated with motion produced by a hand, arm or leg of a pedestrian, while walking, running or bicycling, causes the switch means to synchronously open and close and thereby cause the lamp to flash ON and OFF.

Figure 5:
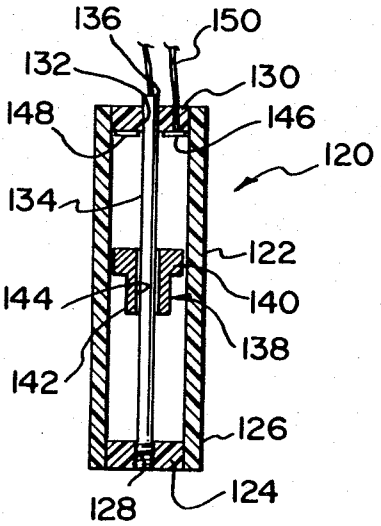
FIG. 5 is a longitudinal cross-section view of an alternative acceleration responsive switch means.

Mercury switches are responsive to both gravity and acceleration, are readily available and relatively inexpensive. Accordingly, they are ideally suited for the purposes of the present invention. However, switch 22 is not strictly limited to mercury switches as exemplified by switch 120 illustrated in FIG. 5.

Switch 120 is comprised of a cylindrical, tubular capsule 122 formed of rigid, non-electrically conductive material, such as plastic. A non-electrically conductive plug 124 is press fitted into end 126 of capsule 122 and formed with a concentric, threaded bore 128. A second non-electrically conductive plug 130 is press fitted into the opposite end of the bore of capsule 122 as shown and is formed with a concentric bore 132. An electrically conductive threaded shaft 134 is threaded into bore 128 and extends through bore 130 as shown. One end 136 of the shaft defines an electrode or terminal for connection to the electrical circuit in the manner described later. A shuttle 138 constructed of electrically conductive material and having a large diameter portion 140, a concentric, small diameter portion 142 and a bore 144 is telescopically received on shaft 134 as shown. Finally, an annular electrically conductive disk 146 is secured to the inner side 148 of plug 130 and serves as a second electrode which is connected to the electrical circuit by a suitable conductor 150.

It will be understood that the shuttle responds to gravity and/or acceleration in substantially the same manner as the mercury droplet in a mercury switch. The orientation of the axis of a mercury switch or switch 120 will determine the position of the casing with respect to the vertical (or horizontal) at which the switches will close and open and at which the lamp will flash ON and OFF. In the position illustrated in FIG. 2, assuming the lamp is disposed vertically upwardly, the critical position of the casing will be horizontal. Switch 22 may be disposed at any desired angle with respect to the axis of a casing without departing from the spirit of the present invention. Further, means may be provided for selectively adjusting by the user the orientation of switch means 22 with respect to the axis of the casing.

Figure 4:
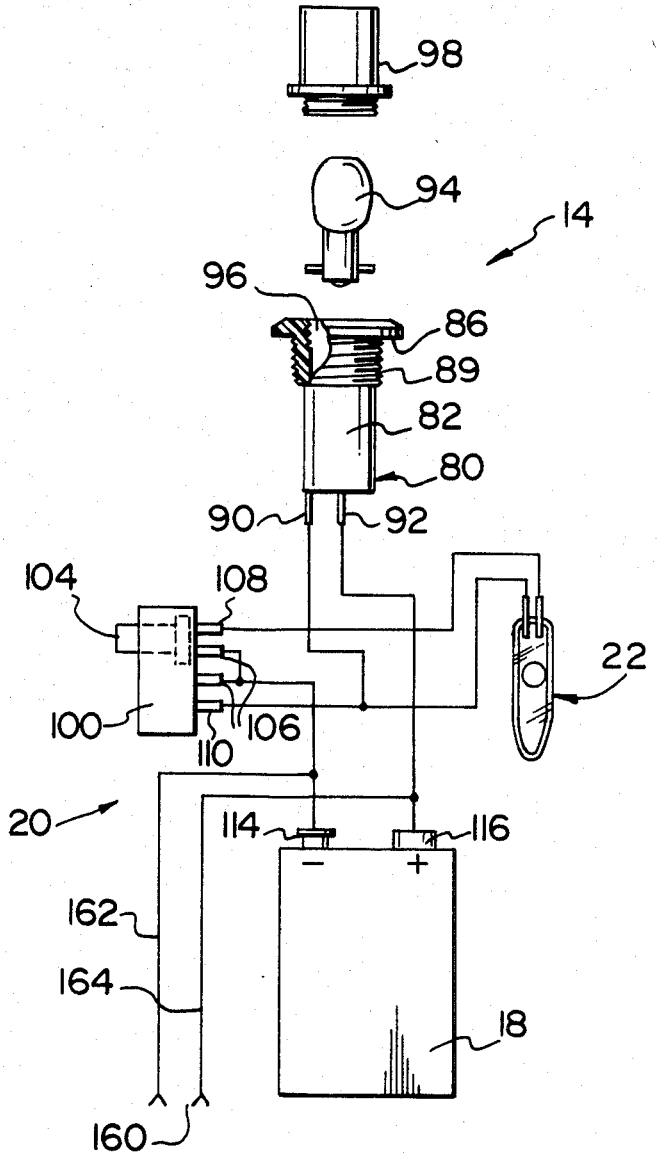
FIG. 4 is a schematic of the electrical circuit housed within the device illustrated in FIG. 1.

As best shown in FIGS. 2 and 4, the two common terminals 106 of switch 100 are connected to negative terminal 114 of battery 18. "Flash" terminal 108 of switch 100 is connected to one electrode of switch means 22. The other electrode of switch means 22 is connected to "continuous" terminal 110 of switch 100 and terminal 90 of lamp assembly 14. Finally, terminal 92 of lamp assembly 14 is connected to positive terminal 116 of battery 18.

It will be seen, therefore, that when the actuating member 104 of switch 100 is disposed in its "continuous" position, switch means 22 is bypassed and the battery is connected directly to the lamp assembly. Thus, the lamp is ON continuously. However, when actuating member 104 is disposed in its "flash" position, switch means 22 is connected in series between the battery and the lamp assembly. Thus, the lamp is actuated only when the casing is disposed in a horizontal or inverted position or acceleration causes the mercury droplet of a mercury switch or shuttle 138, depending upon which embodiment is used, is forced into contact with the two electrodes. The frequency at which this occurs is dependent upon the rate of oscillation of the hand, arm or leg of the user, depending upon the manner in which the device is used.

Figure 7:
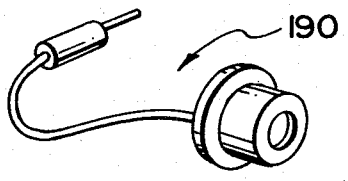
FIG. 7 is a view of an optical, separate audible alarm which may be used in conjunction with the device.

A modification of the device described above involves incorporation of an audible alarm, such as a buzzer, which may be actuated in synchronism with the lamp assembly or which is connected to the battery in a secondary circuit controlled by an appropriate buzzer switch (not shown). Alternatively, the audible 190 alarm may be of the remote type, as shown in FIG. 7, which is connected to the device by means of a jack 160 secured to bottom wall 40 of the casing and which is electrically connected to the battery by conductors 162 and 164. The remote alarm may be adapted to be clipped to the clothing of the user or simply placed in a pocket.

Figure 6:
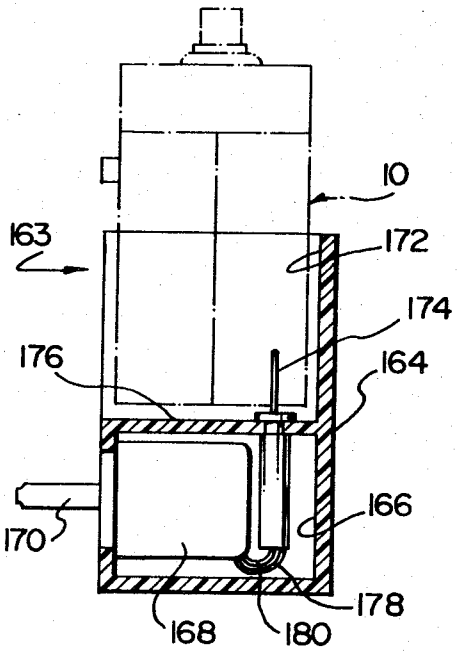
FIG. 6 is a cross-sectional view of a battery charger for the device of FIG. 1.

FIG. 6 illustrates a holder 163 specifically adapted for use in recharging battery 18 without removing the battery from casing 12. The holder is comprised of a housing 164 having a chamber 166 in which a conventional battery charger 168 is mounted and from which plugs 170 of the charger project. A second, open ended chamber 172 is formed at the upper end of housing 164 to receive the safety flasher 10 of the present invention as shown. A plug 174 is secured to wall 176 of the holder with its main body portion disposed within chamber 166 containing the charger and is electrically connected to he charger by conductors 178 and 180. The plug is received within aforementioned jack 160 secured to the underside of device 10.

It will be understood that various other modifications and changes may be made to the above described device without departing from the spirit of the present invention as set forth in the following claims.

The embodiments of the invention in which an exclusive property or privilege is clamed are defined as follows:

1. A personal safety device for producing a controllable flashing light signal, comprising:

a casing constructed of light-weight plastic and arranged to be carried in the hand of a user, including an elongated main body portion having an open top end and a closed bottom end and a cap having a closed top end and an open bottom end arranged to removably telescopingly receive the open top end of said main body portion, said main body, portion and said cap together defining a chamber for removably retaining electrical battery means therein and a hand grippable outer surface;

a lamp assembly secured to and projectng longitudinally from said closed end of said cap, said assembly including a tubular lens having a closed end remote from said casing and a lamp disposed within said lens, said lens having end and side walls permitting light to pass longitudinally and radially, respectively, therethrough;

electrical circuit means disposed in said chamber for electrically connecting said lamp with battery means disposed in said chamber, said circuit means including mercury switch means responsive to the orientation and/or motion of said casing for opening and closing said circuit means and thereby providing positive control of said lamp to produce an "ON" and "OFF" signal; and second switch means for selectively (a) electrically connecting said mercury switch means in series between said lamp assembly and said battery, (b) electrically connecting said lamp assembly directly to said battery and bypassing said mercury switch means for providing control of a continuous light signal, and (c) electrically disconnecting said lamp assembly and battery.

2. A safety flasher as defined in claim 1, said switch means being responsive to gravity for opening or closing said circuit means at a predetermined orientation of said casing.

3. A safety flasher as defined in claim 1, said switch means being responsive to arcuate oscillation of said casing.

4. A safety flasher as defined in claim 1, said switch means being a mercury switch secured to the interior of said casing.

5. A device as defined in claim 1, said flasher further including a selectively operable audible alarm.

6. A device as defined in claim 5, said alarm being mounted within said casing and electrically connected to said battery.

7. A device as defined in claim 5, said circuit means including a jack connector secured to said housing and electrically connected to said battery for electrical connection to a plug, said alarm being a remote alarm having a plug adapted to be connected to said jack connector.

8. A personal safety device for producing a controllable flashing light signal, comprising:

a casing constructed of light-weight plastic and arranged to be carried in the hand of a user, including an elongated main body portion having an open top end and a closed bottom end and a cap having a closed top end and an open bottom end arranged to removably telescopingly receive the open top end of said main body portion, said main body portion and said cap together defining a chamber for removably retaining electrical battery means therein and a hand gripable outer surface;

a lamp assembly secured to and projecting longitudinally from said closed end of said cap, said assembly including a tubular lens having a closed end remote from said casing and a lamp disposed within said lens, said lens having end and side walls permitting light to pass longitudinally and radially, respectively, therethrough;

electrical circuit means disposed in said chamber for electrically connecting said lamp with battery means disposed in said chamber, said circuit means including electromechanical switch means responsive to the orientation and/or motion of said casing for opening and closing said circuit means and thereby providing positive control of said lap to produce an "ON" and "OFF" signal, said switch means including a tubular nonconductive housing, an electrically conductive shaft disposed in said housing and defining a first electrode, an electrically conductive switch element mounted on said shaft for movement therealong in response to the orientation of said casing, and a second electrode secured to said housing electrically contacting said switch element, one of said electrodes being adapted to be electrically connected to one terminal of said battery means and the other of said electrodes being electrically to one terminal of said lamp assembly; and second switch means for selectively (a) electrically connecting said electromechanical switch means in series between said lamp assembly and said battery, (b) electrically connecting said lamp assembly directly to said battery and bypassing said mercury switch means, for providing control of a ccontinuous light signal, and (c) electrically disconnecting said lamp assembly and battery.

9. A device as defined in claim 8, said flasher further including a selectively operable audible alarm.

10. A device as defined in claim 9, said alarm being mounted within said casing and electrically connected to said battery.

11. A device as defined in claim 9, said circuit means including a jack connector secured to said housing and electrically connected to said battery when the latter is disposed in said chamber for electrical connection to a plug, said alarm being a remote alarm having a plug adapted to be connected to said jack connector.

* * * * *

UNITED STATES PATENT AND TRADEMARK OFFICE

CERTIFICATE OF CORRECTION

PATENT NO. : 4,535,392

DATED : August 13, 1985

INVENTOR(S) : William J.I. MONTGOMERY

It is certified that error appears in the above-identified patent and that said Letters Patent are hereby corrected as shown below:

| | |
|---|---|
| Claim 1, column 5, line 42: | delete SECOND "," |
| Claim 8, column 6, line 59: | after the word "electrically" insert --connected--. |
| Claim 8, column 6, line 66: | "ccontinu-" should be --continu- --. |

Signed and Sealed this

*Twenty-sixth* Day of *November 1985*

[SEAL]

*Attest:*

*Attesting Officer*

DONALD J. QUIGG

*Commissioner of Patents and Trademarks*